United States Patent [19]

Rasmussen

[11] Patent Number: 4,846,304

[45] Date of Patent: Jul. 11, 1989

[54] COLLAPSIBLE STEP APPARATUS FOR CABINET SHELVES

[76] Inventor: Willy Rasmussen, 4627 SE. Ina, Milwaukie, Oreg. 97267

[21] Appl. No.: 251,144

[22] Filed: Sep. 30, 1988

[51] Int. Cl.[4] ..... A47B 77/10; A47B 96/00

[52] U.S. Cl. ..... 182/88; 182/35; 182/129; 312/235.1

[58] Field of Search ..... 182/88, 35, 91, 156, 182/129; 312/231, 235

[56] References Cited

U.S. PATENT DOCUMENTS

| | | | |
|---|---|---|---|
| 487,117 | 11/1892 | Farmer | 182/35 |
| 2,436,961 | 3/1948 | Gabriel | 182/88 |
| 3,083,053 | 3/1963 | Dorsey | 312/235 R |
| 3,306,692 | 2/1967 | Timmerman | 312/231 |
| 3,481,429 | 12/1969 | Gaede | 182/88 |
| 3,493,077 | 2/1970 | Dotem | 182/88 |
| 3,756,678 | 9/1973 | Kloppenstein | 312/235 |
| 4,135,604 | 1/1979 | Ryan | 182/91 |
| 4,406,495 | 9/1983 | Turner | 312/235 R |

*Primary Examiner*—Reinaldo P. Machado
*Attorney, Agent, or Firm*—Henderson & Sturm

[57] ABSTRACT

A collapsible step apparatus (10) for use in combination with a kitchen cabinet shelf (101); wherein the apparatus (10) comprises an articulated step unit (11) and a mounting unit (12) adapted to movably secure the articulated step unit (11) to the underside of the kitchen cabinet shelf (101) whereby the articulated step unit (11) may be deployed in an extended or retracted mode relative to the cabinet shelf (101).

6 Claims, 2 Drawing Sheets

FIG. 1.
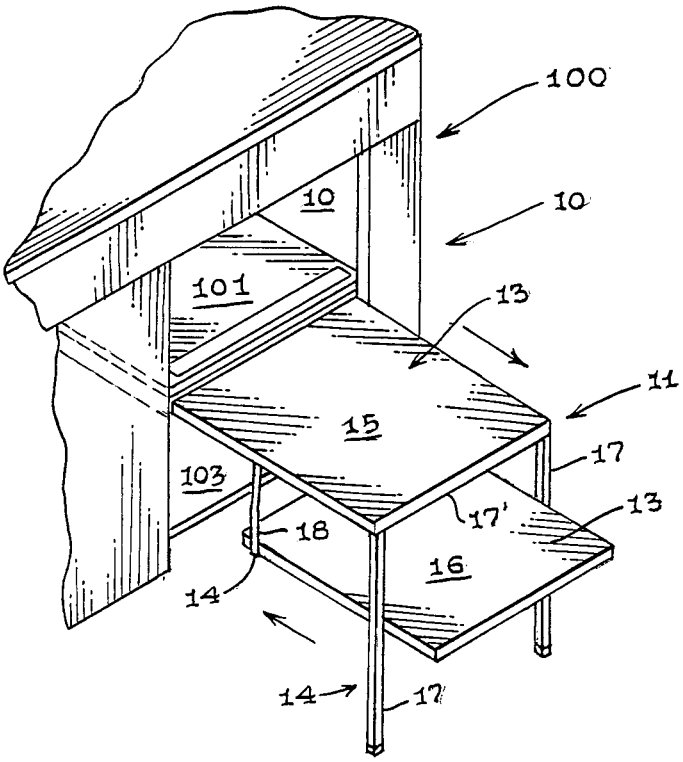
FIG. 2.
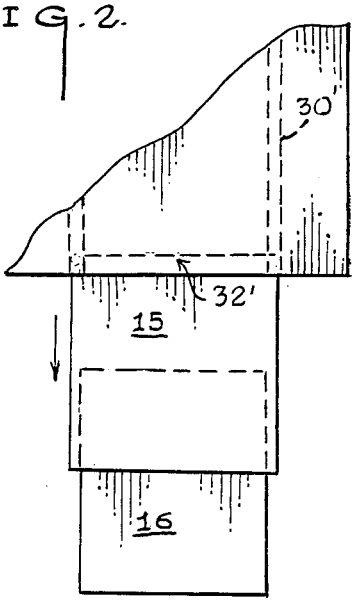
FIG. 3.
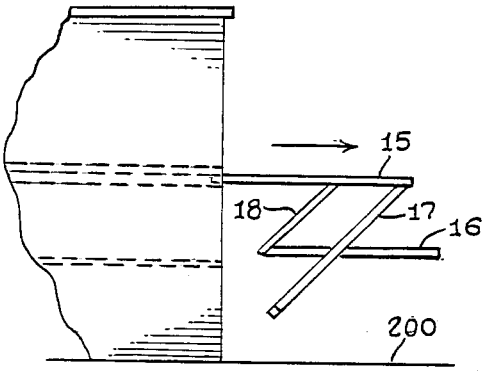
FIG. 4.
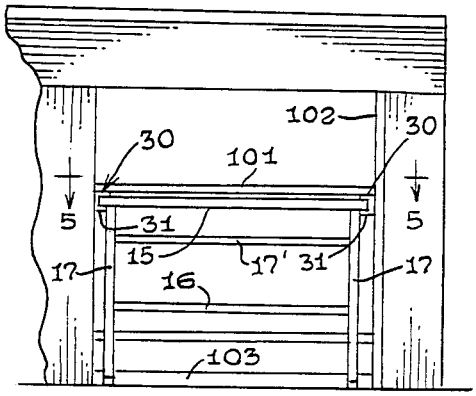
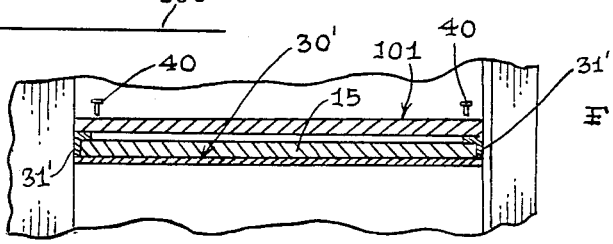
FIG. 5.

COLLAPSIBLE STEP APPARATUS FOR CABINET SHELVES

TECHNICAL FIELD

The present invention relates generally to retractable step arrangements in conjunction with diverse structural elements and more specifically to a retractable step apparatus that cooperates with the underside of a cabinet shelf.

BACKGROUND OF THE INVENTION

As can be seen by reference to the following U.S. Pat. Nos: 3,756,678; 3,306,692; 4,135,604; and, 3,481,429 the prior art is replete with myriad and diverse collapsible and/or retractable step devices for use in conjunction with an independent structural element.

While all of the aforementioned prior art constructions are more than adequate for the particular purpose and function for which they were specifically designed and developed; they also are uniformly deficient in their construction in a number of salient respects.

Most of the prior art retractable step constructions are unduly complex with regard to their own structural components, as well as, their cooperation with the independent structure that they were developed to be used in conjunction with.

In addition, virtually all of the aforementioned prior art devices occupy too much usable space in their host structure and only provide a limited elevation and/or extension capability for the user of the device.

Furthermore, the prior art devices are also usually very difficult to install on a mounting surface on the independent host piece of equipment; and, in many instances the method used to deploy and retract the step apparatus involves a complicated series of maneuvers.

In view of the foregoing situation there has obviously existed a long felt need among consumers who had purchased and used the previously available retractable step devices for an improved collapsible step apparatus that was simple to use and install; and, which also would occupy the least possible space in the host equipment in which it was installed.

It should also be noted that, the one area in the home where a retractable step device is most likely to receive the most frequent use is in the kitchen. This situation arises due the fact that most modern kitchens are provided with both upper and lower kitchen cabinets which are used for the storage of plates, glasses, cookware, and foodstuffs.

In a typical lower kitchen cabinet construction the cabinet normally has a work surface on top disposed above a plurality of drawer elements; wherein, the bottom portion of the cabinet construction is provided with at least one horizontally disposed shelf member suspended and supported on the interior of the cabinet; and, wherein access to the interior of the cabinet is controlled by one or more closure members in the form of a lower cabinet door.

In a typical home the less frequently used kitchen items are normally stored at the top and to the rear of the upper kitchen cabinet for the simple expedient of keeping the more frequently used items where they are readily accessible. However, when circumstances dictate, access must be gained to those items that are stored at the top and rear of the upper kitchen cabinet; and, this chore while normally requiring a stepladder is all too often resolved by the use of a chair with disastrous consequences befalling the user.

In light of the foregoing situation, the present invention was specifically designed to adapt a collapsible step apparatus to the lower shelves of a kitchen cabinet; whereby, the step apparatus will occupy the minimum amount of usable space within the cabinet structure by virtue of its beneath the shelf stored disposition. In addition, the collapsible step apparatus of this invention will be very easy to install relative to the cabinet shelf; and, the shelf apparatus will almost be foolproof with regard to the simplicity involved in the extension and retraction of the step members.

BRIEF SUMMARY OF THE INVENTION

The collapsible step apparatus of this invention comprises in general an articulated step unit and mounting unit for operatively securing the articulated step unit to the underside of a kitchen cabinet shelf. In addition, the articulated step unit is movably disposed relative to the mounting unit such that the articulated step unit may be deployed at selected horizontal displacements relative to the front of the kitchen cabinet.

The mounting unit comprises in general a bracket member having two elongated channel elements that are adapted to slidingly receive cooperating portions of the articulated step unit; wherein, the top of the bracket member is adapted to be secured to the bottom of the kitchen cabinet shelf by suitable securing means.

In addition, the articulated step unit comprises in general a plurality of step members that are operatively connected by a plurality of pivoted leg members; wherein, in the storage mode the leg members are disposed generally parallel to the step members to present as low a profile as possible; while in the extended mode the leg members are disposed generally perpendicular to give vertical support and stability to the step members.

As will be explained in greater detail further on in the specification the articulated step unit is dimensioned such that the leading edge of the articulated step unit is maintained in the storage mode proximate the forward edge of the cabinet shelf by the mounting unit. In addition, the vertical depth of the collapsible step apparatus in the storage mode is approximately equal to the thickness of the cabinet shelf to which it is secured.

Furthermore, when the articulated step unit is deployed in its extended mode, the plurality of step members are disposed in a vertically staggered relationship to one another to approximate a step ladder configuration.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of the collapsible step apparatus deployed in a typical kitchen cabinet environment;

FIG. 2 is a top plan view of the step apparatus and the interior of a kitchen cabinet;

FIG. 3 is a side plan view of the step apparatus and cabinet shelf in the partially collapsed mode;

FIG. 4 is a front plan view of the step apparatus;

FIG. 5 is an enlarged detail view of the apparatus in the collapsed disposition;

BEST MODE FOR CARRYING OUT THE INVENTION

Figure 6:
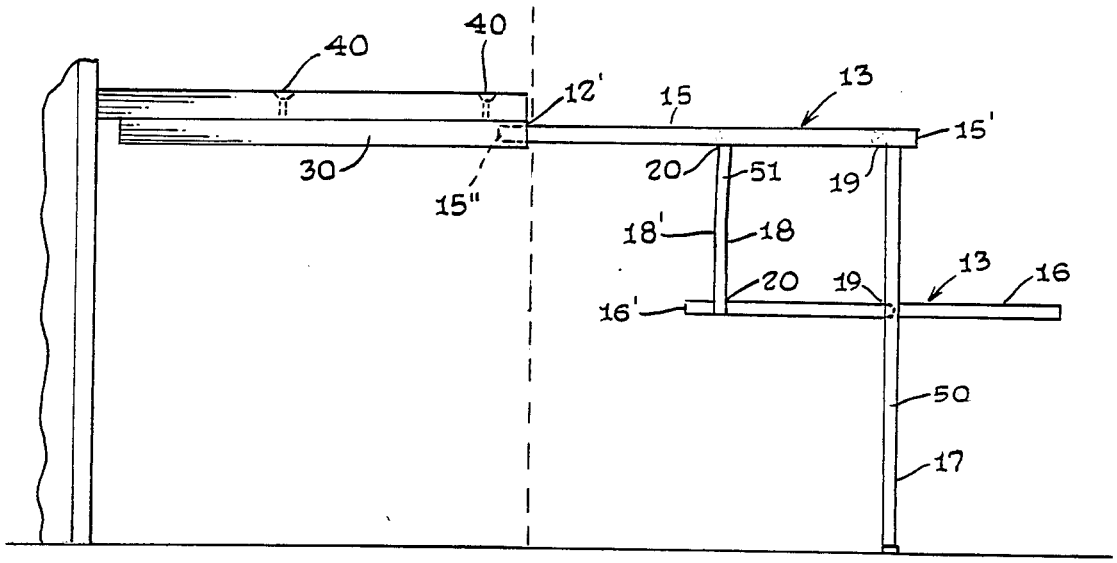
FIG. 6 is a side plan view of the apparatus in the fully extended disposition.

As can be seen by reference to the drawings and in particular to FIG. 1, the collapsible step apparatus that forms the basis of the present invention is designated generally by the reference numeral (10) and designed specifically for use in combination with a typical kitchen cabinet construction designated generally by the reference numeral (100). The collapsible step apparatus (10) comprises in general an articulated step unit (11) and a mounting unit (12). These units will presently be described in seriatim fashion.

Prior to embarking on a detailed description of the collapsible step apparatus (10), it would first be advisable to briefly discuss the typical kitchen cabinet construction (100) that the collapsible step apparatus (10) was specifically developed to be used in combination with.

As shown in FIGS. 1 and 2, the typical kitchen cabinet construction (100) comprises at least one horizontally disposed shelf unit (101) that is operatively secured to one or more of the vertical walls (102) of the cabinet enclosure; wherein, the at least one horizontally disposed shelf unit (101) is suspended and supported above the floor (103) of the cabinet construction (100).

As can be seen by reference to FIG. 1, the articulated step unit (11) comprises a plurality of generally rectangular step members (13) that are operatively connected to one another by a plurality of articulated leg members (14). As best shown in FIGS. 1, 2, and 5, the step members (13) include an upper step element (15) and at least one lower step element (16) which is suspended below and projected outwardly beyond the upper step element (15) in one mode of disposition of the collapsible step apparatus (10).

Turning now to FIGS. 1, 3, and 6, it can be seen that the articulated leg members (14) comprise a first pair of elongated generally tubular support leg elements (17) that are operatively connected to both the upper step element (15) and the at least one lower step element (16); wherein, the first elongated pair of elongated support leg elements (17) are further dimensioned to extend below the at least one lower step element (16) and contact a horizontal floor surface (200) such as a kitchen floor, or the like, in a vertical orientation, in one mode of disposition of the collapsible step apparatus. Furthermore, the first pair of elongated support leg elements (17) are also provided with a cross brace member (17') that lends rigidity to the collapsible step apparatus.

In addition, the articulated leg members (14) also comprise a second pair of generally flat suspension leg elements (18) which only extend between the upper step element (15) and the lower step element (16). As can also be appreciated by reference to FIGS. 6, the first pair of elongated support leg elements (17) are pivotally secured as at (19) both to the outboard end (15') of the upper step element (15), and proximate the middle of the sides of the at least one lower step element (16). Furthermore, the second pair of elongated suspension leg elements (18) are pivotally secured as at (19) proximate the middle of the sides of the upper step element (15) and adjacent the inboard end (16') of the at least one lower step element (16).

As shown in FIGS. 2 and 5, the upper step element (15) has a width that is slightly greater than the lower step element (16); whereby, the articulated leg members (14) will lie alongside in a generally parallel relationship to the lower step element (16), when the collapsible step apparatus (10) is in its stored disposition as depicted in FIG. 5.

Turning now to FIGS. 4 and 5, it can be seem that there are two equally acceptable embodiments of the mounting unit (12). In the first embodiment illustrated in FIG. 4, the mounting unit (12) comprises a pair of bracket members (30); wherein, each of the bracket members (30) comprises an elongated generally C-shaped bracket element (31). In addition, the bracket elements (31) are dimensioned to slidingly receive the opposed edges of the upper step element (15); and, are further provided with conventional securing means (40), such as screws or the like, whereby the top of bracket elements (31) may be secured to the underside of the shelf member (101) in a well recognized fashion.

In the other embodiment shown in FIG. 5, the mounting unit (12) comprises a single elongated rectangular bracket member (30') having a pair of upwardly depending opposed L-shaped bracket elements (31'); wherein, each of the bracket elements (31') is dimensioned to slidingly engage the opposed edges of the upper step element (15); and, wherein the bracket member (30') is provided with suitable securing means (40); whereby the top of the bracket elements (31') may be fastened to the bottom of the shelf member (101) in a well recognized fashion.

In addition, as can be seen particularly by reference to FIG. 2, the leading edge of the bracket member (30') is further provided with a recess (32') that allows the user to grasp the outboard edge (15') of the upper step element (15) when the apparatus (10) is disposed in its storage mode.

Turning now to the embodiment depicted in FIG. 5, it can be appreciated that when the step unit (11) is stored within the mounting unit (12), the lower step element (16) will be nested within the upper step element (15) and both step elements (15)(16) will be slidably received within the space defined by the bracket member (30') the L-shaped bracket elements (31'), and the underside of the shelf (101).

Due to the foregoing arrangement the step unit (11) will be confined within the mounting unit (12), such that the apparatus (10) will have a slim, smooth, compact profile that will occupy very little storage space, and will not have surface projections that will catch on the diverse articles that may be stored beneath the shelf (101).

It should further be appreciated at this juncture that in both embodiments of the mounting unit (12), the bracket members (30)(30') are provided with well recognized stop limit means (not shown), which are disposed proximate the leading edge of the mounting unit (12); whereby, the horizontal displacement of the articulated step unit (11) relative to the mounting unit (12) will be arrested when the inboard edge (15') of the upper step element (15) approaches the outboard end (12') of the mounting unit (12).

At this juncture it should be appreciated that the collapsible step apparatus (10) of this invention occupies a minimum amount of space beneath a shelf (101) in a kitchen cabinet construction (100) when the collapsible step apparatus (10) is in its retracted disposition as depicted in FIG. 5. However, when the user desires to deploy the step apparatus (10) in its extended disposition all that is required is for the user to pull the articulated step unit (11) outwardly relative to the mounting unit (12) and the cabinet shelf (101). At this point the leg members (14) and the lower shelf element (16) may be pivoted downwardly as shown in FIG. 3, until they assume the fully extended disposition depicted in FIGS. 1 and 6.

It should also be appreciated at this point that in order for the articulated step unit to maintain the storage orientation depicted in FIG. 5, there must be a frictional engagement that exists between the leg members (14) and at least one of the step members (13); whereby the upper (15) and lower (16) step elements will remain in a given position relative to one another, in the absence of an external force being exerted by the user on one or the other of the step elements (15)(16) that comprise the articulated step unit (11).

Figure 7:
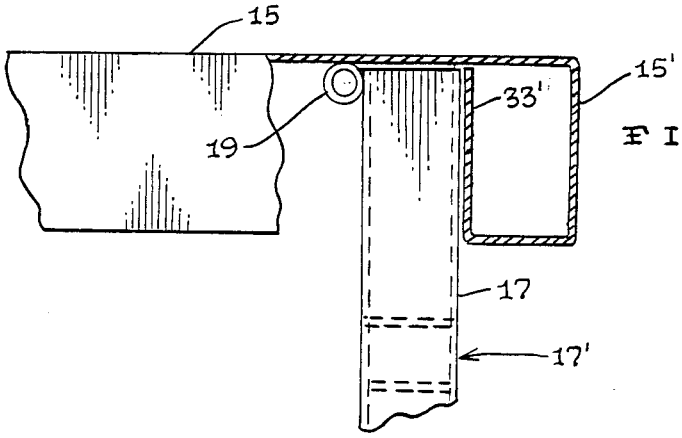
FIG. 7 is an enlarged detailed cross-sectional view of the outboard end of the upper step as viewed from the side; and, FIG. 8 is an enlarged detailed cross-sectional view of a portion of the front end of the apparatus.

Turning now particularly to FIG. 7, it can be seen that the outboard end (1540 ) of the upper step element (15) is turned inwardly to form a stop element (33') disposed proximate to, but spaced from the pivot pin (19) such that the pivotal movement of the first pair of support leg elements (17) about pivot point (19) will be arrested by the engagement of the top and face of the support leg elements (17) with the stop element (33').

Figure 8:
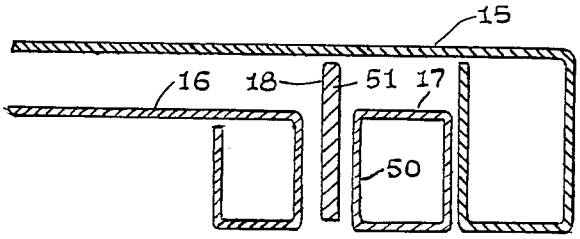

As can be seen by reference to FIGS. 6 and 8, the first pair of support leg elements (17) comprise generally square tubular members (50); and, the second pair of support leg elements (18) comprise generally elongated thin flat members (51); wherein, the midpoint (18') of the second pair of support leg elements (18) are bent outwardly such that the support legs (18) will accommodate the lower pivotal connection (19) on the first pair of support leg elements (17) when the apparatus (10) is in its collapsed mode.

Having thereby described the subject matter that comprises the basis of this invention, it should be apparent that the invention as taught and described herein is only to be limited to the extent of the breadth and scope of the appended claims.

What is claimed is:

1. A collapsible step apparatus in combination with a raised and horizontally disposed kitchen cabinet shelf which is supported and suspended within a floor mounted kitchen cabinet wherein the collapsible step apparatus comprises:

an articulated step unit including a plurality of generally rectangular step members that are operatively connected to one another by a plurality of articulated step members which comprise a pair of elongated support leg elements and a pair of suspension leg elements wherein said leg elements are pivotally secured to said plurality of step members; and, a mounting unit for operatively and movably connecting said articulated step unit to the underside of said kitchen cabinet shelf.

2. The collapsible step apparatus as in claim 1, wherein the said plurality of generally rectangular step members comprise:

an upper step element; and, at least one lower step element, wherein the width of the upper step element is greater than the width of the at least one lower step element; whereby, the plurality of step members are adapted to pivotally rotate to a position generally parallel and adjacent to the sides of the at least one lower step element.

3. The collapsible step apparatus as in claim 2, wherein the pair of elongated support leg elements are pivotally secured to the outboard end of the upper step element and proximate to the middle of the sides of the at least one lower step element; and, wherein the support leg elements are dimensioned to extend from the upper step element and project below the at least one lower step element to contact a horizontal floor surface; whereby the support leg elements will be disposed in a vertical orientation relative to the floor surface and the said plurality of step members.

4. The collapsible step apparatus as in claim 3, wherein the pair of suspension leg elements are pivotally secured proximate the middle of the sides of the upper step element and adjacent the inboard end of the at least one lower step element.

5. The collapsible step apparatus as in claim 1; wherein, the mounting unit includes a pair of bracket members wherein each bracket member comprises an elongated generally C-shaped bracket element wherein each of the bracket members is dimensioned to slidingly engage the opposed edges of the upper step element; and further includes securing means which are adapted to secure the top of the bracket elements to the underside of the kitchen cabinet shelf.

6. The collapsible step apparatus as in claim 1; wherein, the mounting unit comprises: an elongated rectangular bracket member having a pair of upwardly depending opposed generally L-shaped bracket elements wherein each of the bracket elements are dimensioned to slidingly engage the opposed edges of the upper step element; and, securing means which are adapted to secure the top of the bracket member to the underside of the kitchen cabinet shelf.

* * * * *